US011834902B2

(12) United States Patent
Qiu

(10) Patent No.: US 11,834,902 B2
(45) Date of Patent: Dec. 5, 2023

(54) RETURN DEVICE AND WINDPROOF ROLLER SHUTTER FORMED BY RETURN DEVICE

(71) Applicant: GUANGZHOU NEWHOO INTELLIGENT HOME TECHNOLOGY CO., LTD., Guangdong (CN)

(72) Inventor: Yongzhong Qiu, Guangzhou (CN)

(73) Assignee: GUANGZHOU NEWHOO INTELLIGENT HOME TECHNOLOGY CO., LTD., Guangzhou (CN)

( * ) Notice: Subject to any disclaimer, the term of this patent is extended or adjusted under 35 U.S.C. 154(b) by 161 days.

(21) Appl. No.: 17/501,197

(22) Filed: Oct. 14, 2021

(65) Prior Publication Data

US 2022/0034159 A1 Feb. 3, 2022

Related U.S. Application Data

(63) Continuation of application No. PCT/CN2021/086938, filed on Apr. 13, 2021.

(30) Foreign Application Priority Data

Jul. 8, 2020 (CN) ..... 202010651558.1

(51) Int. Cl.
*E06B 9/58* (2006.01)
*E06B 9/42* (2006.01)

(52) U.S. Cl.
CPC ..... *E06B 9/581* (2013.01); *E06B 9/42* (2013.01)

(58) Field of Classification Search
CPC ..... E06B 9/581; E06B 9/42; E06B 9/40
See application file for complete search history.

(56) References Cited

U.S. PATENT DOCUMENTS 510,336 A * 12/1893 Felthousen ..... E06B 9/581 160/269
559,499 A * 5/1896 Scott ..... E06B 9/581 160/DIG. 7

(Continued)

FOREIGN PATENT DOCUMENTS

AU 63401/94 B 7/1997
CN 201953289 U 8/2011

(Continued)

OTHER PUBLICATIONS

International Search Report and Written Opinion of the International Searching Authority issued by the China National Intellectual Property Administration for corresponding International Patent Application No. PCT/CN2021/086938, dated Jul. 14, 2021, with an English translation.

*Primary Examiner* — Beth A Stephan
(74) *Attorney, Agent, or Firm* — Myers Wolin, LLC

(57) ABSTRACT

The disclosure discloses a return device and a windproof roller shutter formed by the return device. The return device includes an end cover, wherein a sliding chute is arranged on the end cover, the sliding chute is arranged slantly, and a horizontal height of a first end of the sliding chute is larger than a horizontal height of a second end of the sliding chute; a sliding component, wherein the sliding component moves along the sliding chute; and a fixed plate mounted at one end of a reel pipe, wherein the sliding component is mounted on the fixed plate. The windproof roller shutter includes a reel pipe, a shutter body, a low rail, two side rails and two return devices.

10 Claims, 10 Drawing Sheets

(56) References Cited

U.S. PATENT DOCUMENTS

| | | | | | |
|---|---|---|---|---|---|
| 5,375,643 | A * | 12/1994 | Rude | E06B 9/90 | 192/81 C |
| 5,566,741 | A * | 10/1996 | Ogawara | E06B 9/90 | 160/297 |
| 8,672,115 | B1 * | 3/2014 | Jennings | F16D 49/02 | 192/223.4 |

FOREIGN PATENT DOCUMENTS

| | | | |
|---|---|---|---|
| CN | 104196434 | A | 12/2014 |
| CN | 104213679 | A | 12/2014 |
| CN | 108301758 | A | 7/2018 |
| CN | 208236297 | U | 12/2018 |
| CN | 109826547 | A | 5/2019 |
| CN | 111997509 | A | 11/2020 |
| CN | 212563036 | U | 2/2021 |
| EP | 0 593 389 | B1 | 1/1997 |
| ES | 1 063 735 | U | 12/2006 |

* cited by examiner

RETURN DEVICE AND WINDPROOF ROLLER SHUTTER FORMED BY RETURN DEVICE

CROSS-REFERENCE TO RELATED APPLICATION

This application is a continuation application of International Application PCT/CN2021/086938, filed on 13 Apr. 2021 and designated the U.S., which claims priority to Chinese patent application No. 202010651558.1, filed Jul. 8, 2020. The contents of these applications are incorporated herein by reference in their entirety.

TECHNICAL FIELD

The present disclosure relates to the field of window decoration, and more particularly, to a return device and a windproof roller shutter formed by the return device.

BACKGROUND

In order to make a roller shutter more practical, more beautiful and more suitable for shading and sheltering requirements of an outdoor sun room, a windproof roller shutter comes into being. Referring to FIG. 1 to FIG. 2, the windproof roller shutter includes a shield roller shutter and two side rails capable of fixing two sides of the roller shutter. However, since a reel pipe is fixed, a fabric wound on the reel pipe leads to a change in a pipe diameter, and rubber strips on two sides of a shutter body often produce friction with the side rails, which seriously affects the lifting of the fabric and a service life of a system. In order to solve the problem of unsmooth lifting, a very heavy low rail is arranged at a lower end of the shutter body, so that it is often difficult to pull the windproof roller shutter.

SUMMARY

The present disclosure aims to address at least one of the technical problems in the prior art, and provides a return device and a windproof roller shutter formed by the return device, which can reduce friction between a shutter body and side rails, so that the shutter body is lifted up and lowered down more smoothly.

According to an embodiment of a first aspect of the present disclosure, a return device is provided, which includes an end cover, wherein a sliding chute is arranged on the end cover, the sliding chute is arranged slantly, and a horizontal height of a first end of the sliding chute is larger than a horizontal height of a second end of the sliding chute; a sliding component, wherein the sliding component moves along the sliding chute; and a fixed plate mounted at one end of a reel pipe, wherein the sliding component is mounted on the fixed plate.

According to an embodiment of the first aspect of the present disclosure, further, the sliding chute is provided with two sliding surfaces, a strip-shaped protrusion is arranged on at least one sliding surface of the sliding chute, and the strip-shaped protrusion is arranged along a length direction of the sliding chute.

According to an embodiment of the first aspect of the present disclosure, further, the sliding component includes at least one first sliding member, and the first sliding member is matched with the strip-shaped protrusion.

According to an embodiment of the first aspect of the present disclosure, further, the return device further includes a supporting device, wherein the supporting device is located at the second end of the sliding chute, and the supporting device is capable of abutting against the reel pipe or a shutter body on the reel pipe.

According to an embodiment of the first aspect of the present disclosure, further, the supporting device includes a supporting device bracket and a rotating assembly, the rotating assembly is rotatably mounted on the supporting device bracket, and an axial direction of the rotating assembly is perpendicular to a moving direction of the sliding component along the sliding chute.

According to an embodiment of the first aspect of the present disclosure, further, the end cover includes a cover plate and a bottom plate, the sliding chute is arranged on the bottom plate, an upper portion of the cover plate is provided with an upper stopper, a lower portion of the cover plate is provided with a lower stopper, an accommodating cavity is formed between the upper stopper and the lower stopper, and the bottom plate is fixed in the accommodating cavity.

According to an embodiment of the first aspect of the present disclosure, further, a cushion block is arranged between the lower stopper and the bottom plate, and the cushion block is located below the first end of the sliding chute.

According to an embodiment of the first aspect of the present disclosure, further, the end cover further includes an adjusting bolt, an adjusting screw hole is arranged in the lower stopper, and the adjusting bolt penetrates through the adjusting screw hole and then abuts against the bottom plate or the sliding chute.

According to an embodiment of a second aspect of the present disclosure, a windproof roller shutter is provided, which includes a reel pipe, a shutter body, a low rail, two side rails and the two return devices above, wherein two ends of the reel pipe are respectively connected with the two return devices, the second end of the sliding chute is close to the side rail, the shutter body is mounted on the reel pipe, the low rail is fixed on a bottom edge of the shutter body, and two sides of the shutter body slide along the side rails respectively.

According to an embodiment of the second aspect of the present disclosure, further, two side edges of the shutter body are respectively provided with a zipper portion along a length direction, the side rail includes a zipper guide groove, a top portion of the zipper guide groove is provided with a guide seal, two opposite limiting portions are arranged on the guide seal, the limiting portion includes a side plate and a limiting plate, the side plates of the two limiting portions are opposite to form a zipper space capable of allowing the zipper portion to pass through, a shutter body gap capable of allowing the shutter body to pass through is formed between the limiting plates of the two limiting portions, and a width of an opening at an upper portion of the shutter body gap is larger than that of an opening at a lower portion of the shutter body gap.

The present disclosure has the beneficial effects that: when the shutter body is lifted up and lowered down, the reel pipe moves on the sliding chute through the sliding component under an action of gravity, so that the shutter body can always vertically enter the side rails, friction between the shutter body and the side rails is effectively reduced, the windproof roller shutter can be ensured to be lifted up and lowered down smoothly without needing to arrange the low rail with a larger weight, a load of a motor is reduced, and a service life of the windproof roller shutter is prolonged.

BRIEF DESCRIPTION OF THE DRAWINGS

In order to explain the technical solutions in the embodiments of the present disclosure more clearly, the accompanying drawings needing to be used in description of the embodiments are briefly described hereinafter. Obviously, the described accompanying drawings are only some but not all of the embodiments of the present disclosure, and those skilled in the art may also obtain other design schemes and accompanying drawings according to these accompanying drawings without going through any creative work.

DETAILED DESCRIPTION

Figure 1:
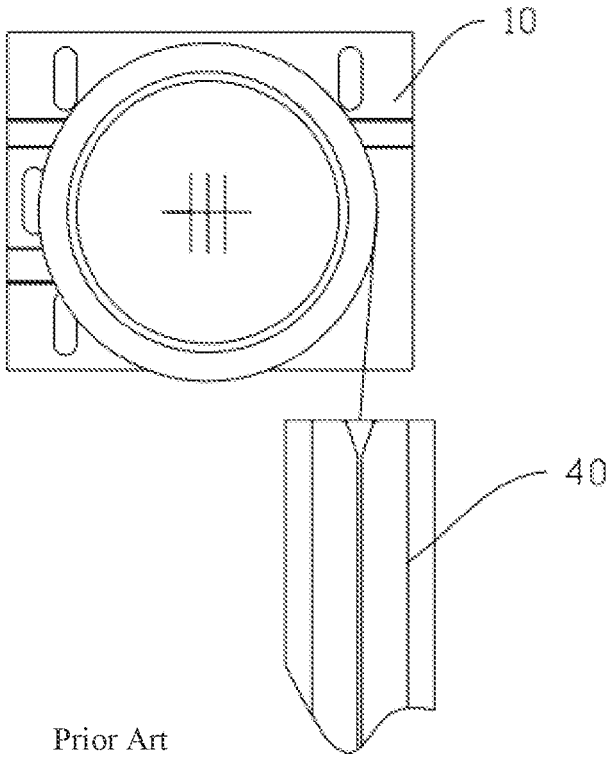
FIG. 1 is a schematic diagram in a case of maximum shutter bodies on a reel pipe in the prior art.
Figure 2:
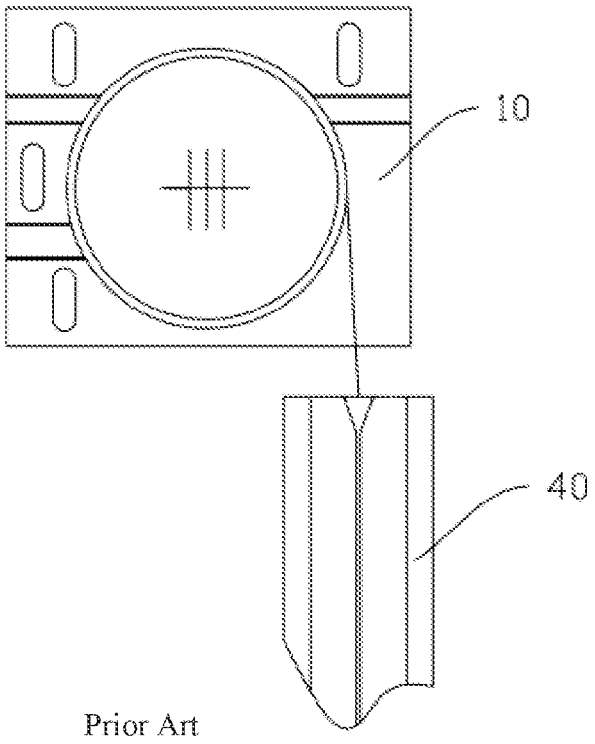
FIG. 2 is a schematic diagram in a case of minimum shutter bodies on the reel pipe in the prior art.

This part will describe the specific embodiments of the present disclosure in detail, and the preferred embodiments of the present disclosure are shown in the accompanying drawings. The accompanying drawings are used to supplement the description of the text in the description with the graphs, so that people can intuitively and vividly understand each technical feature and the overall technical solution of the present disclosure, but the accompanying drawings cannot be understood as limiting the scope of protection of the present disclosure.

In the description of the present disclosure, it shall be understood that the orientation or position relation related to the orientation description, such as the orientation or position relation indicated by the upper, lower, front, rear, left, right, etc., is based on the orientation or position relation shown in the drawings, which is only configured to convenience of description of the present disclosure and simplification of description instead of indicating or implying that the indicated device or element must have a specific orientation, and be constructed and operated in a specific orientation, and thus shall not be understood as a limitation to the present disclosure.

In the description of the present disclosure, the meaning of several refers to be one or more, and the meaning of multiple refers to be more than two. The meanings of greater than, less than, more than, etc., are understood as not including this number, while the meanings of above, below, within, etc., are understood as including this number. If there is a description to the first and second, it is only for the purpose of distinguishing technical features, and shall not be understood as indicating or implying relative importance, implicitly indicating the number of the indicated technical features or implicitly indicating the order of the indicated technical features.

In the description of the present disclosure, unless otherwise clearly defined, words such as setting, installation, connection, etc., shall be understood broadly, and those skilled the art can reasonably determine the specific meanings of the above words in the present disclosure in combination with the specific contents of the technical solution.

In the present application, a so-called vertical direction refers to a lifting direction of a shutter body 60, and similarly, a horizontal direction refers to a direction perpendicular to the lifting direction of the shutter body 60.

Figure 8:
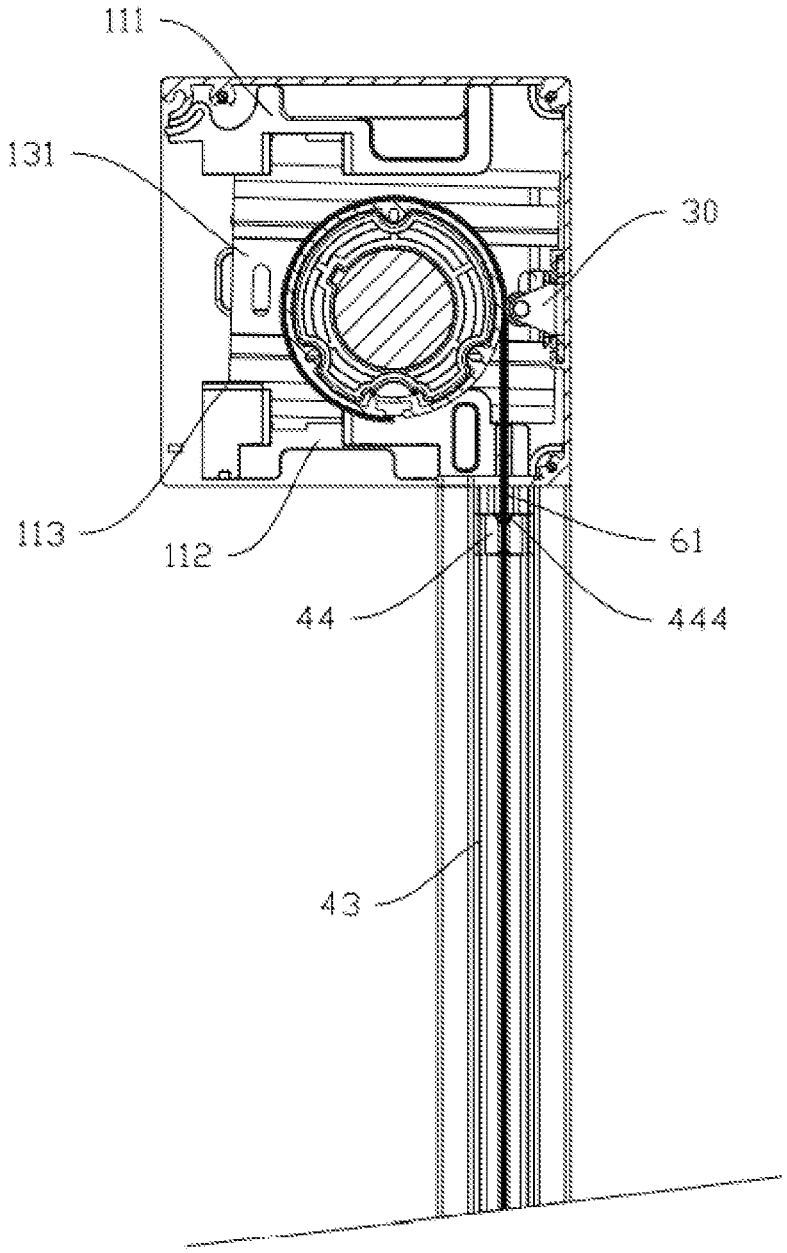
FIG. 8 is a cross-section view of the return device matched with side rails in the embodiment of the present disclosure.
Figure 9:
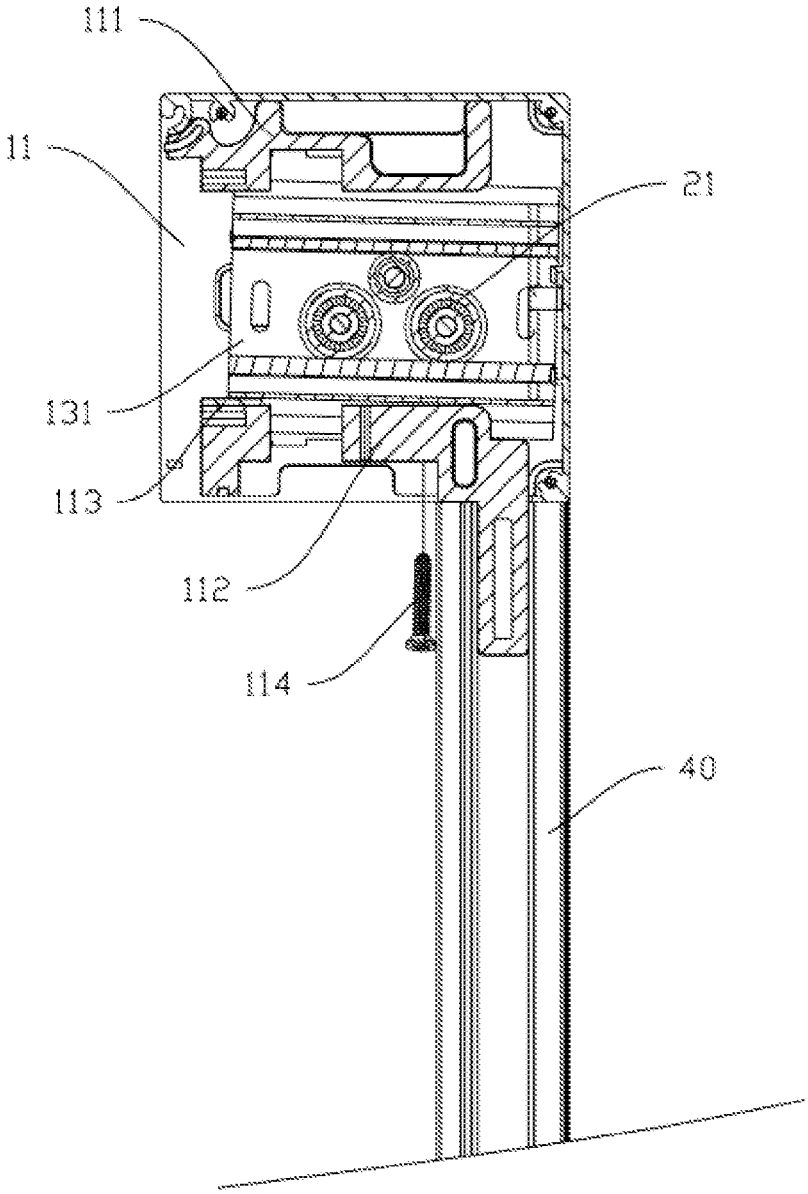
FIG. 9 is a cross-section view of the return device matched with the side rails in the embodiment of the present disclosure (omitting the reel pipe and a bottom plate)
Figure 13:
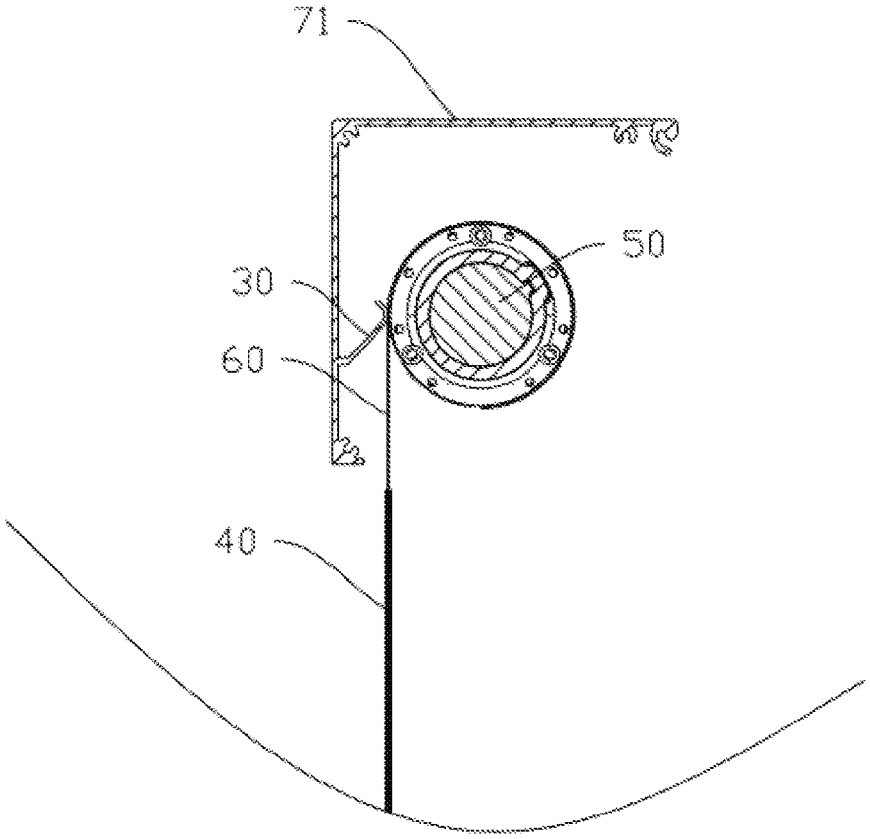
FIG. 13 is a schematic diagram of mounting of another embodiment of the supporting device in the present disclosure.

Referring to FIG. 8 to FIG. 9, a return device in an embodiment of the present disclosure includes an end cover 10, a sliding component 21 and a fixed plate 20. The sliding component 21 is mounted on the fixed plate 20, and the fixed plate 20 is connected with one end of a reel pipe 50. A sliding chute 131 is arranged on the end cover 10, and the sliding component 21 moves along the sliding chute 131. The sliding chute 131 is arranged slantly, and a horizontal height of a first end of the sliding chute 131 is larger than a horizontal height of a second end of the sliding chute 131, so that the sliding component 21 can roll towards the second end of the sliding chute 131 under an action of gravity. During mounting, the second end of the sliding chute 131 on the end cover 10 is mounted above the side rail 40, so that the reel pipe 50 can automatically move towards the second end of the sliding chute 131 under an action of gravity when a number of shutter bodies 60 on the reel pipe 50 is reduced, which means that a direction in which side edges of the shutter body 60 on the reel pipe 50 enter the side rails 40 is basically parallel to a guiding direction of the side rails 40, thus reducing friction between the shutter body 60 and the side rails 40. More importantly, one end of the reel pipe 50 can automatically move towards the second end of the sliding chute 131 along with the sliding component 21, instead of pulling a reel to move towards the side rails 40 through the shutter body 60, which further reduces friction between the shutter body 60 and the side rails 40, and also reduces friction between the sliding component 21 and the sliding chute 131 at the same time. Therefore, the sliding component 21 moves more conveniently and flexibly. Further, with reference to FIG. 13, in order to make a direction in which the side edges of the shutter body 60 enter or withdraw from the side rails 40 always parallel to the guiding direction of the side rails 40, the return device further includes a supporting device 30. The supporting device 30 is located at the second end of the sliding chute 131, and the supporting device 30 is capable of abutting against the reel pipe 50 or the shutter body 60 on the reel pipe 50. Although an excircle formed by the shutter body 60 wound around the reel pipe 50 may change with the lifting of the shutter body 60, under an action of gravity, the reel pipe 50 or the shutter body 60 on the reel pipe 50 is capable of always abutting against the supporting device 30, thus pushing the sliding assemblies 21 at two ends of the reel pipe 50 to move along the sliding chute 131. That is, a center of the reel pipe 50 may move back and forth due to a change in size of the shutter body 60 wound around the reel pipe 50, and a number of the shutter bodies 60 wound around the reel pipe 50 determines a diameter of the reel pipe 50 around which the shutter bodies 60 are wound, so that a center position of the reel pipe 50 can be automatically adjusted. A position where the supporting device 30 abuts against the reel pipe 50 or the shutter body 60 on the reel pipe is located right above a guiding space of the side rails 40, so that an edge of the shutter body 60 can always be parallel to the guiding direction of the side rails 40. A zipper portion 61 of the shutter body 60 always enters a zipper guide groove 43 vertically, thus reducing friction between the zipper portion 61 and the zipper guide groove 43, reducing wear of the zipper portion 61, also reducing resistance caused by the friction between the zipper portion 61 and the zipper guide groove 43, further reducing a load of a motor, and prolonging a service life of the motor.

Figure 11:
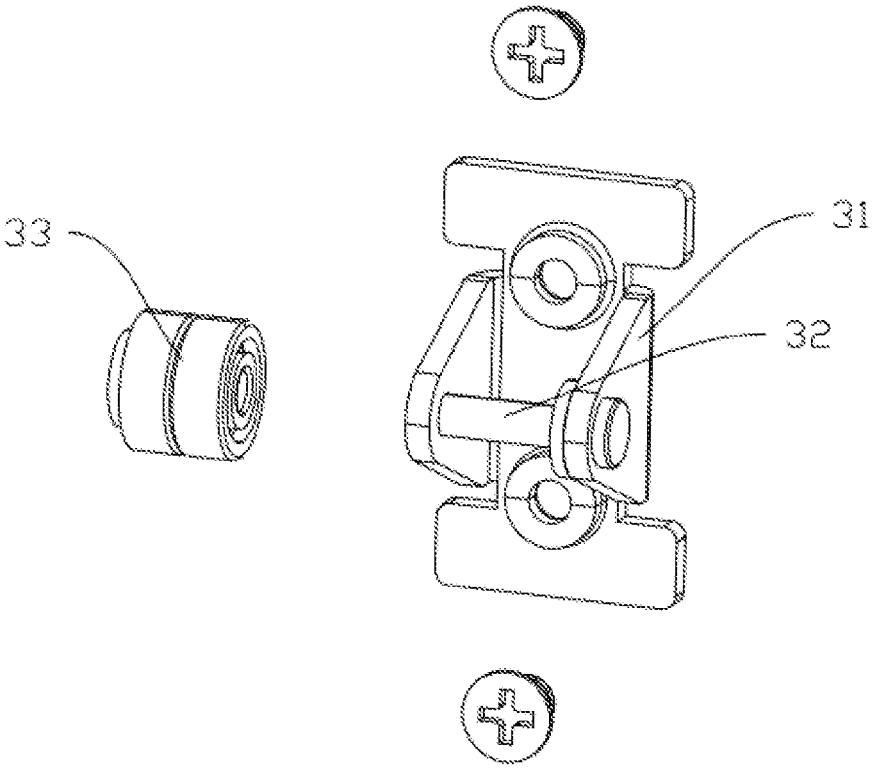
FIG. 11 is an exploded view of a supporting device in the embodiment of the present disclosure.
Figure 12:
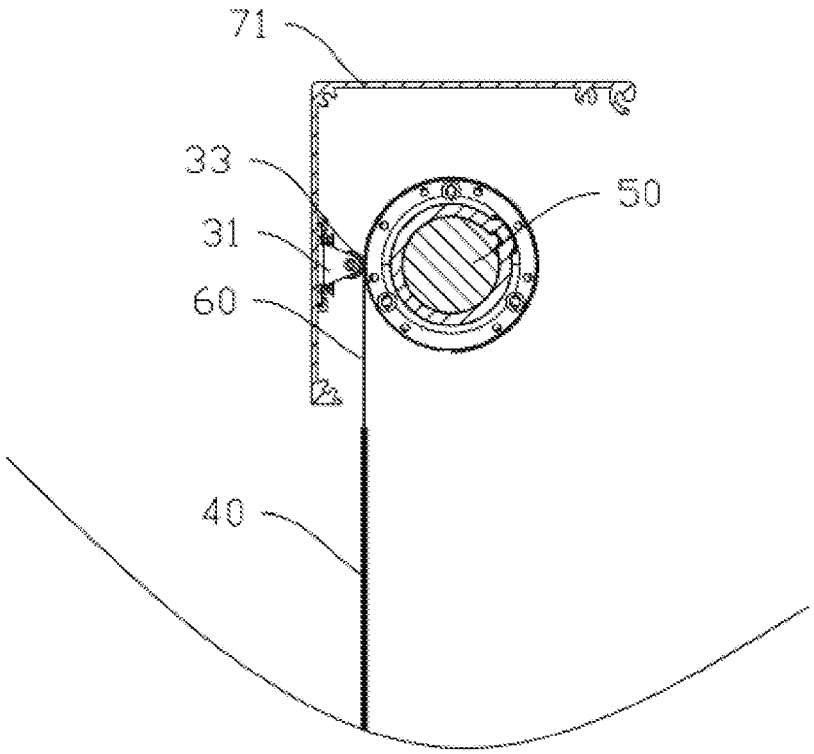
FIG. 12 is a schematic diagram of mounting of the supporting device in the embodiment of the present disclosure.

Preferably, with reference to FIG. 11 to FIG. 12, the supporting device 30 includes a supporting device bracket 31 and a rotating assembly. The rotating assembly is rotatably mounted on the supporting device bracket 31, and an axial direction of the rotating assembly is perpendicular to a moving direction of the sliding component 21 along the sliding chute 131. The rotating assembly may include a rotating bearing 33 and a central shaft 32. The central shaft 32 is fixed on the supporting device bracket 31, and the rotating bearing 33 is rotatably mounted on the central shaft 32. When the reel pipe 50 rotates, the supporting device 30 supports the reel pipe 50 and the shutter body 60 on the reel pipe, while the rotating bearing 33 can also rotate in an opposite direction with the reel pipe 50 and the shutter body 60 on the reel pipe, thus effectively reducing friction between the supporting device 30 and the reel pipe 50 and the shutter body 60 on the reel pipe, which not only can protect a fabric of the shutter body 60 from damage, but also is more beneficial for light load rotation of the reel pipe 50. Therefore, the lifting of the shutter body 60 has a smaller resistance, and is smoother.

The end cover 10 may be integrally formed with the sliding chute 131 to simplify a structure. In the embodiment, in order to improve an adjustability of an inclination angle of the sliding chute 131 and interchangeability between parts, the end cover 10 includes a cover plate 11 and a bottom plate, and the sliding chute 131 is arranged on the bottom plate. Specifically, an upper portion of the cover plate 11 is provided with an upper stopper 111, a lower portion of the cover plate 11 is provided with a lower stopper 112, an accommodating cavity is formed between the upper stopper 111 and the lower stopper 112, and the bottom plate is fixed in the accommodating cavity. By replacing different bottom plates into the accommodating cavity, the inclination angle of the sliding chute 131 may be adjusted, so as to adapt to the reel pipes 50 of different weights and the shutter bodies 60 of different thicknesses, thus achieving a better effect. As an optional embodiment, the sliding chute 131 is horizontally arranged on an end surface of the bottom plate, which means that a sliding direction of the sliding chute 131 is parallel to an upper side surface of the bottom plate, and the upper side surface and a lower side surface of the bottom plate are parallel. Accordingly, a bottom surface of the accommodating cavity forms a certain angle with a horizontal direction, and when the bottom plate is mounted in the accommodating cavity, the sliding chute 131 can be inclined at a certain angle with the horizontal direction.

As another optional embodiment, the sliding chute 131 is slantly arranged on the end surface of the bottom plate, which means that the sliding direction of the sliding chute 131 forms a certain angle with the upper side surface of the bottom plate, and the upper side surface and the lower side surface of the bottom plate are parallel. When the bottom plate is mounted in the accommodating cavity, the sliding chute 131 is inclined at a certain angle with the horizontal direction. In this way, the inclination angle of the sliding chute 131 on the end cover 10 may be adjusted by replacing different bottom plates.

Further, as a preferred embodiment, the bottom plate includes a sliding chute plate 13 and a positioning plate 12. The sliding chute 131 is arranged on the sliding chute plate 13, and the sliding chute plate 13 is fixed on the positioning plate 12. Preferably, two ends of the sliding chute 131 are respectively provided with an elongated through hole 132, and the two elongated through holes 132 are vertically arranged in the sliding chute plate 13. Accordingly, two positioning screw holes are arranged in the positioning plate 12, and positioning bolts pass through the elongated through holes 132 in the sliding chute plate 13 and then are inserted into the positioning screw holes in the positioning plate 12 for fixing. Before tightening the positioning bolts, a position of the sliding chute plate 13 on the positioning plate 12 may be adjusted up and down, so that a height of the sliding chute 131 may be adjusted to adapt to the reel pipe 50. In addition, the positioning bolts also limit the sliding component 21, and prevent the sliding component 21 from falling out of the sliding chute 131.

Further, in order to adjust the inclination angle of the sliding chute 131 more flexibly, a cushion block 113 is arranged between a lower stopper 112 and the bottom plate, and the cushion block 113 is located below the first end of the sliding chute 131. Since the cushion block 113 cushions the bottom plate, a height of the first end of the sliding chute 131 is increased. By replacing the cushion blocks 113 of different thicknesses, the inclination angle of the sliding chute 131 may be adjusted more flexibly without replacing the bottom plate. Accordingly, in order to add the cushion block 113, a gap is provided between the accommodating cavity and the bottom plate which are matched. After the cushion block 113 is provided, in order to stably mount the bottom plate in the accommodating cavity, the end cover 10 further includes an adjusting bolt 114, an adjusting screw hole is arranged in the lower stopper 112, and the adjusting bolt 114 penetrates through the adjusting screw hole and then abuts against the bottom plate or the sliding chute 131. In the embodiment, after placing the cushion block 113 on a bottom surface of the accommodating cavity, the bottom plate is put into the accommodating cavity, a bottom surface of the bottom plate abuts against the cushion block 113, then the adjusting bolt 114 is screwed into the adjusting screw hole, and the adjusting bolt 114 abuts against the bottom plate, thus tightly pushing the bottom plate in the accommodating cavity, and finely adjusting and positioning the height of the sliding chute 131.

Figure 3:
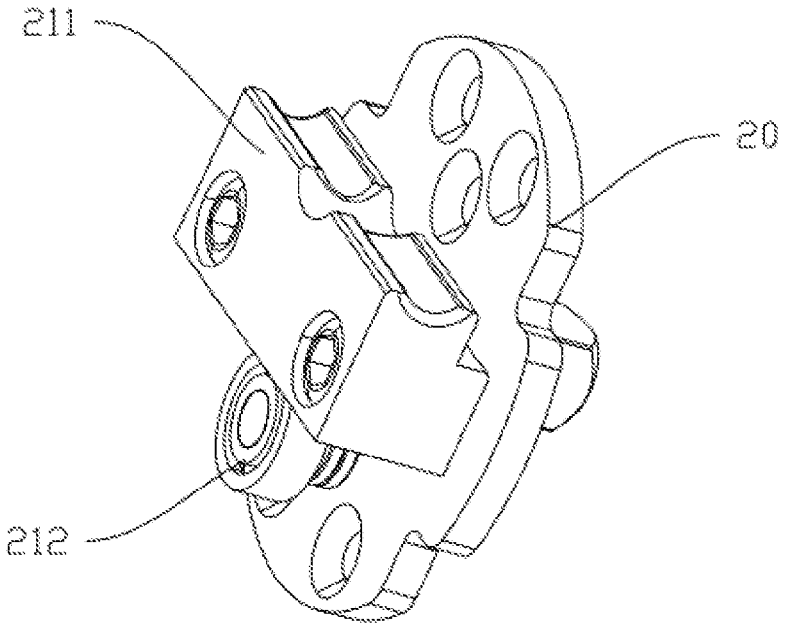
FIG. 3 is a schematic diagram of an embodiment of a sliding component in the present disclosure.
Figure 6:
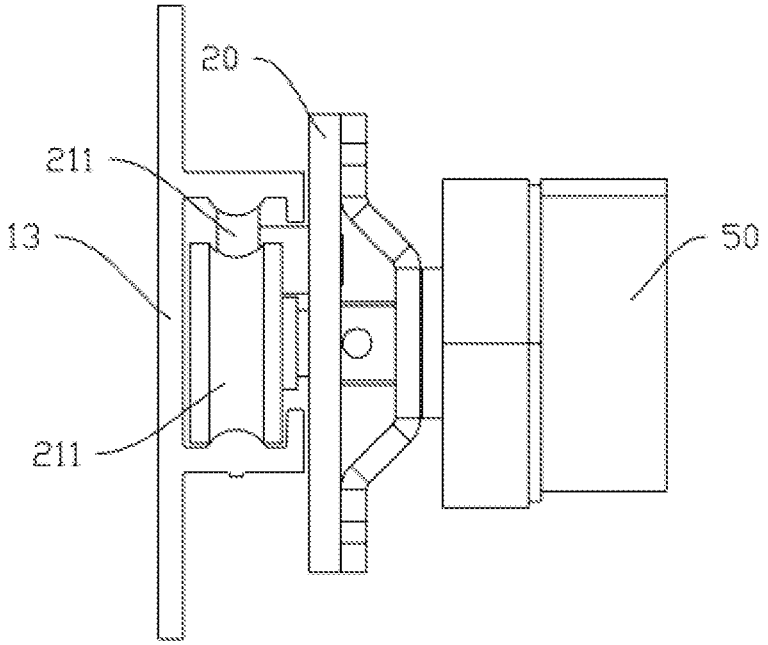
FIG. 6 shows an embodiment of a return device in the present disclosure.
Figure 7:
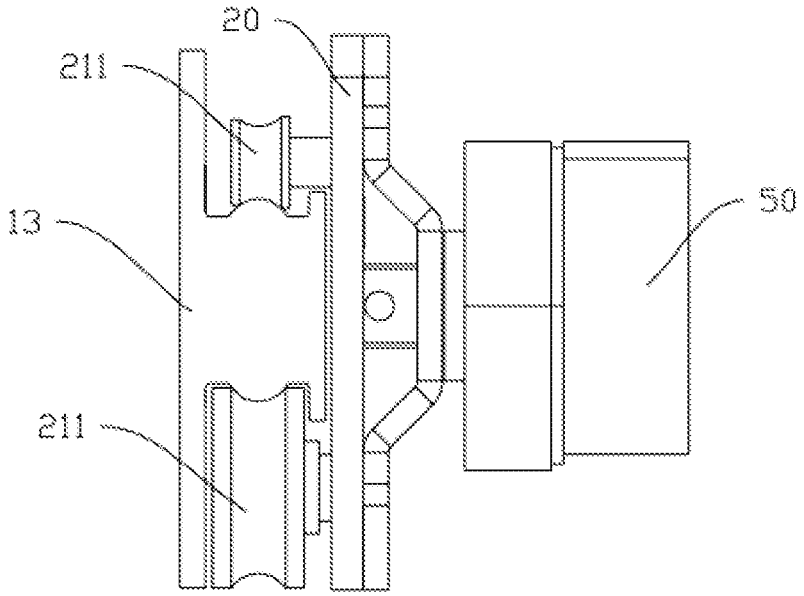
FIG. 7 shows another embodiment of the return device in the present disclosure.

Referring to FIG. 6 to FIG. 7, the sliding chute 131 is provided with two sliding surfaces, a strip-shaped protrusion is arranged on at least one sliding surface of the sliding chute 131, and the strip-shaped protrusion is arranged along a length direction of the sliding chute 131. The two sliding surfaces of the sliding chute 131 may be located on two opposite inner sides of the sliding chute or two opposite outer sides of the sliding chute. A cross-section of the strip-shaped protrusion may be semi-circular, triangular or rectangular. Accordingly, the sliding component 21 includes at least one first sliding member 211, and the first sliding member 211 is matched with the strip-shaped protrusion. In the embodiment, the first sliding member 211 is a groove-shaped bearing. As an equivalent, with reference to FIG. 3, the first sliding member 211 may be a sliding block with a groove-shaped structure.

As an optional embodiment, the strip-shaped protrusion is arranged on one of the sliding surfaces of the sliding chute 131. The sliding component 21 includes at least one first sliding member 211 and at least one second sliding member 212. The first sliding member 211 abuts against the sliding surface provided with the strip-shaped protrusion, while the second sliding member 212 abuts against the sliding surface not provided with the strip-shaped protrusion. The first sliding member 211 and the second sliding member 212 are both mounted on the fixed plate 20 through rotating shafts. Preferably, in order to ensure that the sliding component 21 can slide continuously along the sliding chute 131, when one first sliding member 211 is provided, two second sliding members 212 are provided. A horizontal position of the first sliding member 211 is located between horizontal positions of the two second sliding members 212, and triangular distribution is formed among the first sliding member 211 and the two second sliding members 212, so that the first sliding member 211 and the second sliding members 212 can always cling to the sliding surfaces of the sliding chute 131 to move. Similarly, when one second sliding member 212 is provided, two first sliding members 211 are provided. Optionally, the second sliding member 212 may be a rolling bearing.

As another optional embodiment, the strip-shaped protrusions are arranged on the two sliding surfaces of the sliding chute 131. Accordingly, the sliding component 21 includes at least two first sliding members 211, and the first sliding members 211 abut against the two sliding surfaces of the sliding chute 131 respectively. The first sliding members 211 are both mounted on the fixed plate 20 through rotating shafts. Preferably, in order to ensure that the sliding component 21 can slide continuously along the sliding chute 131, three first sliding members 211 are provided, and triangular distribution is formed among the three first sliding members 211, wherein two first sliding members 211 abut against one sliding surface of the sliding chute 131, and another first sliding member 211 abuts against the other sliding surface of the sliding chute 131.

Figure 4:
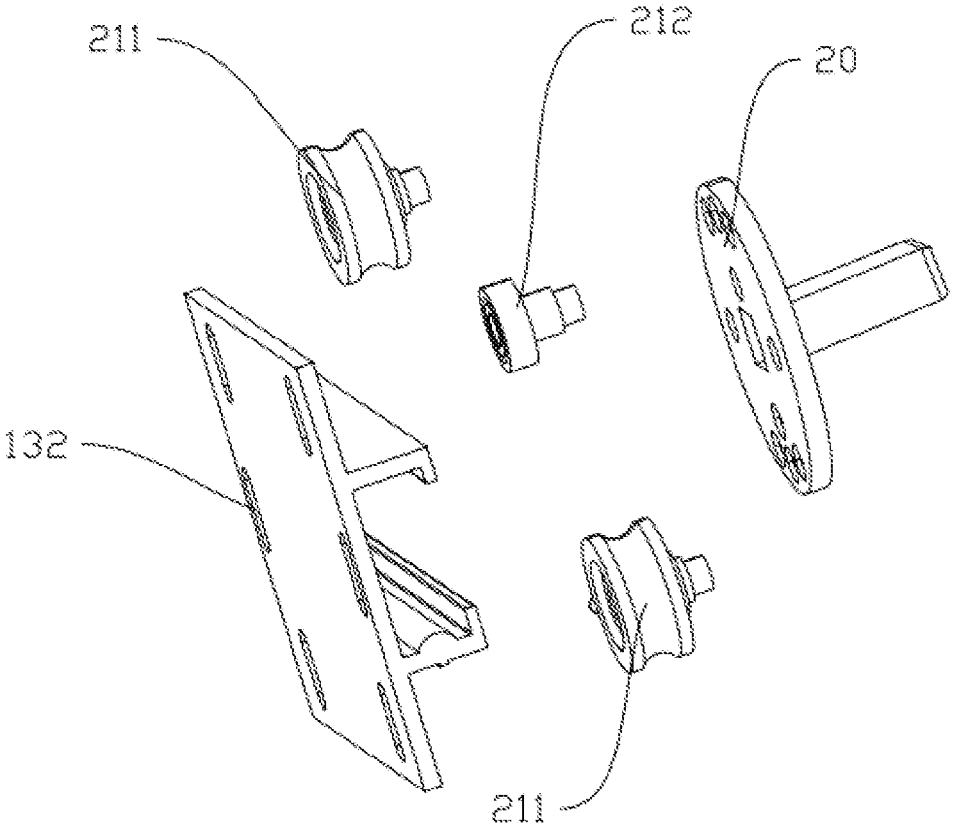
FIG. 4 is an exploded view of a windproof roller shutter balancer at a motor end in an embodiment of the present disclosure.
Figure 5:
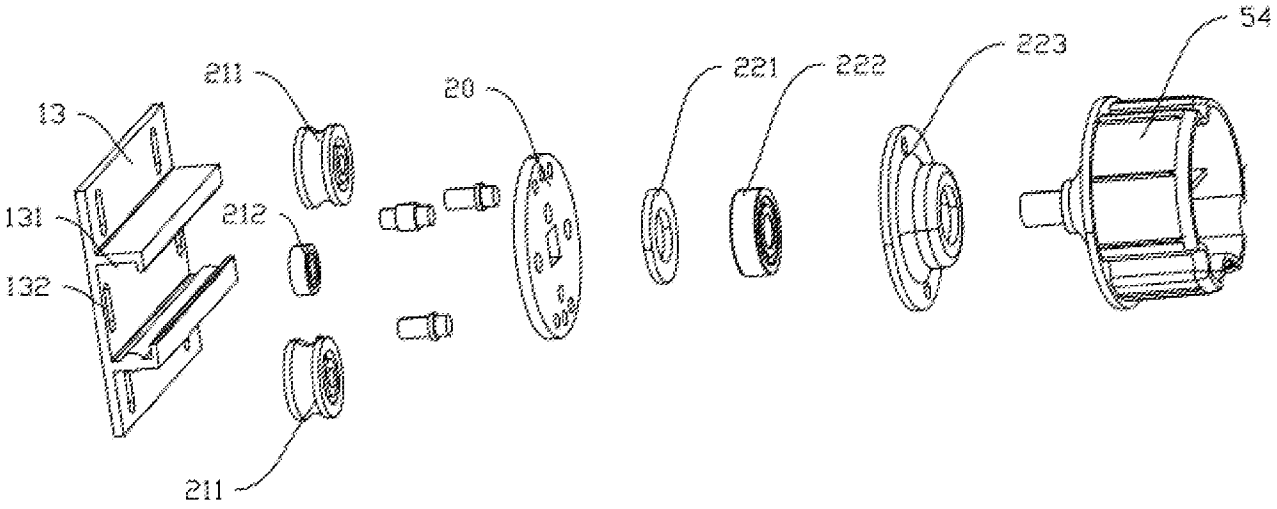
FIG. 5 is an exploded view of a windproof roller shutter balancer at a tail end in the embodiment of the present disclosure.

Referring to FIG. 4 to FIG. 5, the return device may be connected with a motor end and a tail end of the reel pipe 50 respectively, and the return device connected with different end portions has a different specific structure.

A structure of the return device connected with the motor end refers to FIG. 4, one end surface of the fixed plate 20 is provided with the sliding component 21, and the other end surface of the fixed plate 20 is provided with a square shaft. The square shaft can be inserted into a square hole of a motor 51. When the motor 51 is started, since the square shaft is fixed in the square hole of the motor 51, the motor 51 cannot rotate relative to the fixed plate 20, so that a roller shutter rod connected with the motor 51 rotates.

A structure of the return device connected with the tail end refers to FIG. 5, a tail end bracket 223 is arranged on the fixed plate 20, a tail end bearing 222 is arranged between the fixed plate 20 and the tail end bracket 223, a bracket through hole is arranged in the tail end bracket 223, and the bracket through hole is communicated with an inner through hole of the tail end bearing 222. Preferably, the tail end bearing 222 is fixed on the end surface of the fixed plate 20 through a washer 221, and the tail end bracket 223 prevents the tail end bearing 222 from falling off from the fixed plate 20. The tail end bracket 223 is connected with the fixed plate 20 through a bolt. A connecting shaft at the tail end passes through the bracket through hole and is fixed in the inner through hole of the tail end bearing 222, so that the tail end of the reel pipe 50 can rotate freely.

Figure 10:
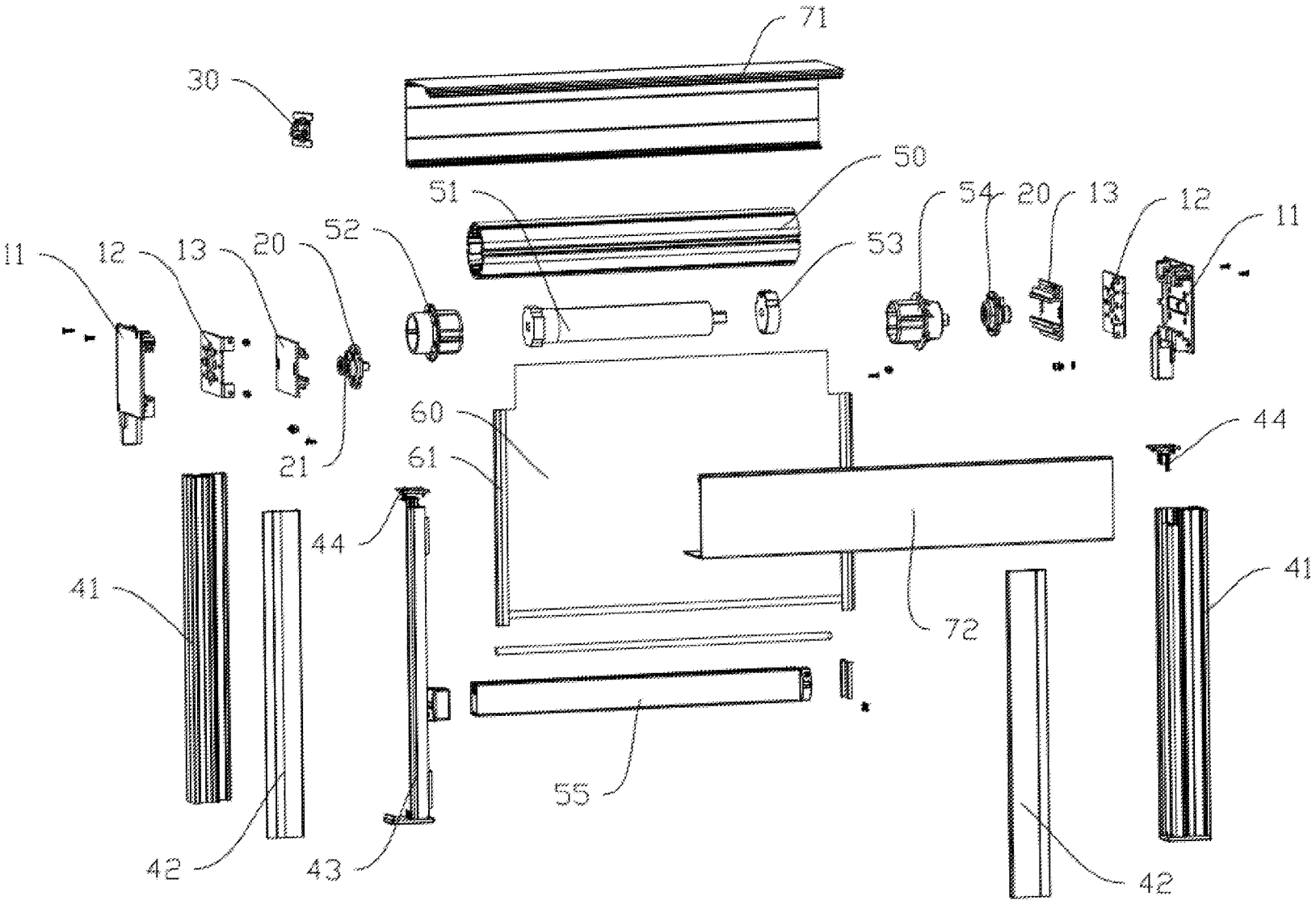
FIG. 10 is an exploded view of a windproof roller shutter in the embodiment of the present disclosure.

Referring to FIG. 10, a windproof roller shutter in an embodiment of the present disclosure includes a reel pipe 50, a shutter body 60, a low rail 55, two side rails 40 and the above return device. The shutter body 60 is mounted on the reel pipe 50, and the low rail 55 is fixed on a bottom edge of the shutter body 60. Two ends of the reel pipe 50 are respectively connected with two return devices. The motor 51 is arranged in the reel pipe 50, and the square shaft on the fixed plate 20 of the return device connected with a head end is inserted into the square hole of the motor 51. An output end of the motor 51 is connected with the reel pipe 50 through a rotating wheel 53, and the rotating wheel 53 is connected with an inside of the reel pipe 50. A counting clip of the motor 51 is connected with the reel pipe 50 through a crown 52. The tail end of the reel pipe 50 is connected with the return device through a tail plug 54, and the connecting shaft on the tail plug 54 is inserted into the inner hole of the tail end bearing. The second end of the sliding chute 131 is close to the side rails 40, and two side edges of the shutter body 60 slide along the side rails 40 respectively, so that the side edges of the shutter body 60 can enter the side rails 40 with very low friction or even no friction.

Preferably, the windproof roller shutter further includes a first shield 71 and a second shield 72. A reel pipe mounting space can be enclosed by combining the first shield 71 and the second shield 72. A lower portion of the reel pipe mounting space is provided with a gap capable of allowing the shutter body 60 to pass through, and the two return devices are respectively mounted at two ends of the reel pipe mounting space. In the embodiment, the supporting device 30 is mounted in the reel pipe mounting space. Specifically, two supporting devices 30 may be mounted on the first shield 71 or the second shield 72 together.

Figure 14:
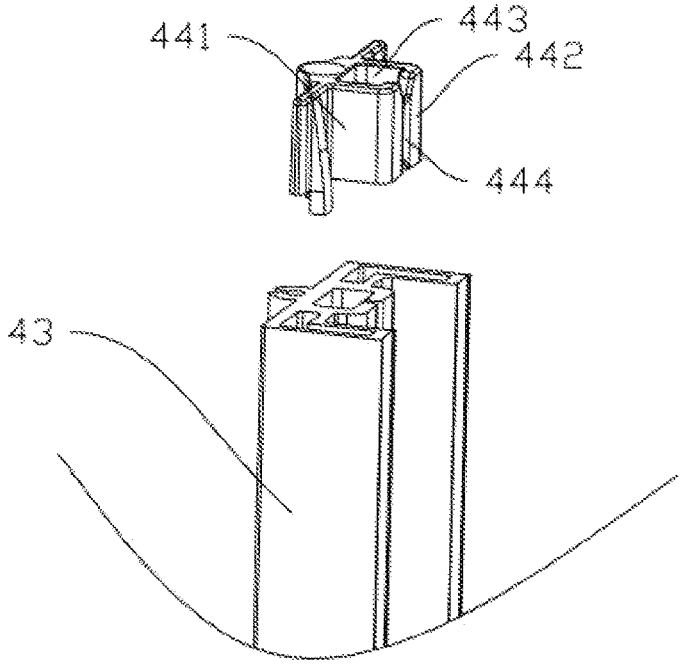
FIG. 14 is a schematic diagram of the side rails and a guide seal in the embodiment of the present disclosure.

Referring to FIG. 10 and FIG. 14, the side rail 40 includes a side rail body 41, a side rail cover 42 and a zipper guide groove 43. Accordingly, two side edges of the shutter body 60 are respectively provided with a zipper portion 61 along a length direction, and the zipper portions 61 on two sides of the shutter body 60 are respectively matched with the zipper guide grooves 43 of the two side rails 40. Preferably, a top portion of the zipper guide groove is provided with a guide seal 44. Two opposite limiting portions are arranged on the guide seal 44, the limiting portion includes a side plate 441 and a limiting plate 442, the side plates 441 of the two limiting portions are opposite to form a zipper space 443 capable of allowing the zipper portion 61 to pass through, a shutter body gap 444 capable of allowing the shutter body 6 to pass through is formed between the limiting plates 442 of the two limiting portions, and a width of an opening at an upper portion of the shutter body gap 444 is larger than that of an opening at a lower portion of the shutter body gap. The zipper portion 61 passes through the guide seal 44 and then is matched with the zipper guide groove 43. Since the width of the opening at the upper portion of the shutter body gap 444 of the guide seal 44 is large, it is beneficial for the shutter body 60 to penetrate into the shutter body gap 444, and convenient for assembly of the shutter body 60.

The foregoing describes the preferred embodiments of the present disclosure in detail, but the present disclosure is not limited to the embodiments. Those skilled in the art may further make various equivalent modifications or substitutions without violating the spirit of the present disclosure, and these equivalent modifications or substitutions are all included in the scope defined by the claims of the present application.

What is claimed is:

1. A return device, comprising:

an end cover, wherein a sliding chute is arranged on the end cover, the sliding chute is arranged slantly, and a horizontal height of a first end of the sliding chute is larger than a horizontal height of a second end of the sliding chute;

a sliding component, wherein the sliding component moves along the sliding chute; and a fixed plate mounted at one end of a reel pipe, wherein the sliding component is mounted on the fixed plate; and a supporting device, wherein the supporting device is located at the second end of the sliding chute, and the supporting device is capable of abutting against the reel pipe or a shutter body on the reel pipe.

2. The return device of claim 1, wherein the sliding chute is provided with two sliding surfaces, a strip-shaped protrusion is arranged on at least one of the sliding surfaces of the sliding chute, and the strip-shaped protrusion is arranged along a length direction of the sliding chute.

3. The return device of claim 2, wherein the sliding component comprises at least one first sliding member, and the first sliding member is matched with the strip-shaped protrusion.

4. The return device of claim 1, wherein the supporting device comprises a supporting device bracket and a rotating assembly, the rotating assembly is rotatably mounted on the supporting device bracket, and an axial direction of the rotating assembly is perpendicular to a moving direction of the sliding component along the sliding chute.

5. The return device of claim 1, wherein the end cover comprises a cover plate and a bottom plate, the sliding chute is arranged on the bottom plate, an upper portion of the cover plate is provided with an upper stopper, a lower portion of the cover plate is provided with a lower stopper, an accommodating cavity is formed between the upper stopper and the lower stopper, and the bottom plate is fixed in the accommodating cavity.

6. The return device of claim 5, wherein a cushion block is arranged between the lower stopper and the bottom plate, and the cushion block is located below the first end of the sliding chute.

7. The return device of claim 5, wherein the end cover further comprises an adjusting bolt, an adjusting screw hole is arranged in the lower stopper, and the adjusting bolt penetrates through the adjusting screw hole and then abuts against the bottom plate or the sliding chute.

8. A windproof roller shutter, comprising a reel pipe, a shutter body, a low rail, two side rails and two return devices of claim 1, wherein two ends of the reel pipe are respectively connected with the two return devices, the second end of the sliding chute is close to one of the side rails, the shutter body is mounted on the reel pipe, the low rail is fixed on a bottom edge of the shutter body, and two sides of the shutter body slide along the side rails respectively.

9. The windproof roller shutter of claim 8, wherein two side edges of the shutter body are respectively provided with a zipper portion along a length direction, each of the side rails comprises a zipper guide groove, a top portion of the zipper guide groove is provided with a guide seal, two opposite limiting portions are arranged on the guide seal, each of the limiting portions comprises a side plate and a limiting plate, the side plates of the two limiting portions are opposite to form a zipper space capable of allowing the zipper portion to pass through, a shutter body gap capable of allowing the shutter body to pass through is formed between the limiting plates of the two limiting portions, and a width of an opening at an upper portion of the shutter body gap is larger than that of an opening at a lower portion of the shutter body gap.

10. The return device of claim 6, wherein the end cover further comprises an adjusting bolt, an adjusting screw hole is arranged in the lower stopper, and the adjusting bolt penetrates through the adjusting screw hole and then abuts against the bottom plate or the sliding chute.

* * * * *